US005090077A

United States Patent [19]

Caden et al.

[11] Patent Number: 5,090,077

[45] Date of Patent: Feb. 25, 1992

[54] CELLULAR PATIENT SUPPORT FOR THERAPEUTIC AIR BEDS

[75] Inventors: John J. Caden; Linda C. Caden, both of Miami, Fla.; Norman B. Eads; Jack H. Hess, both of Houston, Tex.

[73] Assignee: Health Products, Inc., Houston, Tex.

[21] Appl. No.: 758,354

[22] Filed: Sep. 9, 1991

Related U.S. Application Data

[63] Continuation of Ser. No. 638,028, Jan. 7, 1991, abandoned, which is a continuation of Ser. No. 413,248, Sep. 27, 1989, abandoned.

[51] Int. Cl.[5] ..... A47C 27/08

[52] U.S. Cl. ..... 5/456; 5/453; 5/455

[58] Field of Search ..... 5/453, 455, 456, 464, 5/470, 469

[56] References Cited

U.S. PATENT DOCUMENTS

| | | | |
|---|---|---|---|
| 945,234 | 1/1910 | Hinsdale | 5/455 |
| 1,307,825 | 6/1919 | Marshall | 5/455 |
| 2,245,909 | 6/1941 | Enfiajian | 5/455 |
| 3,822,425 | 7/1974 | Scales | 5/469 |
| 3,879,776 | 4/1975 | Solen | 5/453 |
| 3,909,858 | 10/1975 | Ducker | 5/455 |
| 3,959,835 | 6/1976 | Nos | 5/455 |
| 4,482,465 | 1/1991 | Nagata | 5/450 |
| 4,638,519 | 1/1987 | Hess | 5/469 |
| 4,679,264 | 7/1987 | Mollura | 5/455 |
| 4,745,647 | 5/1988 | Goodwin | 5/496 |
| 4,944,060 | 7/1990 | Peery | 5/455 |

FOREIGN PATENT DOCUMENTS

| | | | |
|---|---|---|---|
| 136261 | 4/1985 | European Pat. Off. | 5/455 |
| 2807038 | 8/1979 | Fed. Rep. of Germany | 5/455 |
| 2090734 | 7/1982 | United Kingdom | 5/455 |
| 2141333 | 12/1984 | United Kingdom | 5/453 |
| 86/06624 | 11/1986 | World Int. Prop. O. | 5/453 |

*Primary Examiner*—Renee S. Luebke
*Assistant Examiner*—F. Saether
*Attorney, Agent, or Firm*—James L. Jackson

[57] ABSTRACT

A cellular patient support for therapeutic air beds according to the present invention for comprises an air cell container forming a plurality of air cell receptacles disposed in side-by-side relation. A plurality of low air loss air cells are removably positioned within respect ones of the air cell receptacles. An elongate air supply manifold extends along the length of the air cell container and is connected in air supplying relation with each of the air cells. Each of the connectors for the air cells is provided with a pressure control orifice which controls the respective pressure of the air cells and the air supply manifold in relation to the air delivery pressure of the air supply manifold. The air cells are removable from the air cell container and thus the container structure is capable of being efficiently cleaned to enhance the therapeutic aspect of the air bed system.

17 Claims, 2 Drawing Sheets

CELLULAR PATIENT SUPPORT FOR THERAPEUTIC AIR BEDS

This is a continuation of co-pending application Ser. No. 07/638,028 filed on Jan. 7, 1991, now abandoned, which is a continuation of application Ser. No. 07/413,248 filed on Sept. 27, 1989 by John J. Caden, Linda C. Caden, Norman B. Eads, and Jack H. Hess and entitled Multi-Cell, Cellular Therapeutic Air Bed now abandoned.

FIELD OF THE INVENTION

This invention relates generally to therapeutic air beds such as are utilized in hospitals and other convalescent facilities to provide therapeutic support for patients during long periods of convalescence. More specifically, the present invention concerns a cellular air mattress construction for air beds having a cellular container forming a plurality of air cell receptacles each having an air cell removably disposed therein and wherein groups of the air cells are maintained at preselected pressure ranges by means of fixed orifices in the respective air supplies therefor.

BACKGROUND OF THE INVENTION

Therapeutic air beds having multiple air cells disposed in side by side relation and forming an air inflated patient support are well known as evidenced by the prior U.S. Pat. No. 4,638,519 of Jack H. Hess, a joint inventor hereof, and by U.S. Pat. Nos. 3,822,425 of Seales and 4,525,886 of Hunt, et al. In most cases, these air controlled patient support systems are divided into body support segments that are maintained at different pressures to support different parts of a patient's body. For example, the air cells of most therapeutic air bed are arranged into a plurality of segments, each segment being maintained at a preselected pressure range for support of a particular portion of the patient's body. It is typical for such therapeutic air beds to have five or more patient body support segments each at different pressures.

The air supply systems and air cell pressure control mechanisms for air beds having a number of patient support segments are typically quite complex and are therefore quite expensive. It is desirable to provide a novel therapeutic air bed arrangement that having a plurality of patient body support segments and which is of quite simple and inexpensive nature and is reliable in use.

Therapeutic air beds are particularly used by patients who are likely to be bedridden for a significant period of time and are likely to be immobile for extended periods. These patients are typically subject to the development of pressure induced lesions if conventional hospital beds are employed. These pressure inducted lesions develop because the capillaries in the skin of the patient are compressed and blood flow is restricted due to the mechanical interface pressure that is caused by the weight of the patient and the resistance of the patient support surface of the bed. Due to insufficient blood flow, the skin in these high pressure areas beings to deteriorate and pressure lesions ultimately result as the skin tissue deteriorates. Therapeutic air beds were developed in general to accommodate patients who are likely to be bedridden for extended periods of time or likely to be immobile for extended periods and patients who have particular skin problems such as burns. The material from which the upper portion of the air beds is composed tends to form about the patient's body to a certain extent, thereby evenly distributing the weight of the patient to the supporting surface of the air bed. This feature minimizes the likelihood that any particular portion of the patient's body will be subjected to sufficient mechanical pressure that blood flow to skin tissues will be impeded. Therapeutic air beds, therefor, minimize the possibility that patients will develop pressure induced lesions.

Another important aspect of therapeutic air beds is that many of them provide for circulation of air from the air cells upwardly to the patient support structure of the air bed and also to the patient. This gentle upward flow of air is typically emitted from a plurality of holes along the upper surface of the air cells or through perforations formed when the material of the air cells is sewn or through porous material of the air cells themselves. This flowing air is effective to remove moisture from the material of the air bed so that the therapeutic value of the air bed will not be impeded by moisture. It is desirable t o provide an air bed construction of simple and efficient nature which is capable of continuously emitting a gentle upward flow of moisture through the material of the patient support system to therefore provide for patient comfort and to enhance the therapeutic aspects of the air bed construction.

It is also well known that the material from which air beds are composed tends to become soiled in a short period of time as the patient perspires and as medication or other foreign liquid or solid materials come into contact with the material of the air bed. In most cases the air cells and other components of the air bed system are quite difficult and expensive to clean. It is desirable, therefore, to provide a therapeutic air inflated patient support system that can quickly and easily be disassembled and subjected to ordinary cleaning such as laundering, dry cleaning, etc.

SUMMARY OF THE INVENTION

According to the principles of this invention, a cellular therapeutic air bed system is provided which incorporates an air cell container structure which defines a cellular air cell support and positioning system. The air cell container includes upper and lower sheets of material that are disposed in substantially parallel, spaced relation and which are interconnected by a plurality of transverse partitions that separate the space between the upper and lower sheets into a plurality of individual air cell receptacles. The upper and lower spaced sheets and the transverse partitions may, if desired, be composed of the same or different fabric material. This air cell container is capable of being laundered or cleaned as needed to enhance the therapeutic aspects of the patient support system.

Within each of the air cell receptacles is removably positioned an elongated low air loss air cell composed of fabric material and having an air inlet receptacle at one end thereof. The air cell also forms a plurality of air outlet holes, in the nature of pin holes through which air bleeds from the air cell and thereby flows upwardly through the upper portion of the air bed system to the patient. These air outlet openings or ports are typically located along the upper surfaces of the air cells, but may be located in any other suitable position as suits the therapy that is provided for the patient. It should be born in mind that the air outlet openings or ports may be defined by needle holes in the air cell material which are formed as the material from which the air cells are composed is sewn. Also, if desired, the air cells may be composed of air pervious fabric material, thereby allowing air to continuously flow from the entire surface area of the air cells to the surrounding fabric material of the therapeutic patient support structure.

An elongated, tubular air supply manifold extends along the length of the bed such that it comes into juxtaposition with the end portions of each of the air cells. This manifold is preferably flexible and thus may be effectively composed of a fabric material that is impervious to air. The tubular air supply manifold includes an air inlet connector for each of the air cells, these connectors being evenly spaced along the length of the tubular manifold. The air inlet connectors are connected to the respective air inlet receptacles of the individual air cells, thereby providing for efficient supply of each of the air cells with compressed air from the tubular fabric air supply manifold.

It is desirable to establish preselected pressure ranges for each of a plurality of groups of air cells along the length of the therapeutic air bed system. For example, the air bed may incorporate 20 air cells, divided into five groups of five air cells each. Each of these groups of air cells will be maintained at a preselected pressure range as selected for the therapy and comfort of the patient. The air inlet connectors and air inlet receptacles for each of the groups of air cells are provided with pressure control orifices of a particular dimension to insure that all of the air cells of each of the air cell groups are maintained at substantially the same pressure. Thus, an air supply to the tubular fabric manifold can be provided which supplies compressed air at a predetermined maximum pressure and volume. The pressure control orifices of the respective groups of air cells will then insure that the air pressure of the air cells for that particular group will have a predetermined pressure that is equal to or less than the pressure of the air supply to the tubular air supply manifold.

The air supply for the cellular air bed system of this invention will typically incorporate an air blower driven directly by a single speed electrical motor. Thus, the motor and air blower system for the air supply system will be of simple and inexpensive nature. Air from the motor powered blower is directed into a pressure control chamber having a single air supply outlet that is in communication with the elongated tubular manifold of the air bed system. The pressure control chamber has one or more pressure vent openings which will allow air to be discharged from the pressure control chamber to the atmosphere under the control of a motor controlled valve member. With the pressure control valve closed, pressure control chamber and, the tubular manifold and thus the air cells will be at their respective maximum pressures as established by the pressure control orifices of the respective air cells. With the pressure control valve fully open, sufficient air will be vented from the pressure control chamber and thus the tubular manifold such that the air cells will be at their respective minimum pressures. The pressure control valve is capable of various settings between the minimum and maximum pressure levels to permit the patient or nursing personnel to select a pressure range in the pressure control chamber that will provide appropriate comfort and therapeutic value to the patient. At both the high and low pressure settings of the relative pressure control system and at all selected pressures therebetween the pressure relationships between the groups of air cells of the air bed system will be maintained. The patient's body, therefore, will be adequately supported at all pressure levels of the air bed system. The motor of the control valve is adjusted by a simple motor control circuit to increase or decrease the firmness of the therapeutic air bed as suits the comfort and needs of the patient.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF PREFERRED EMBODIMENT

Figure 1:
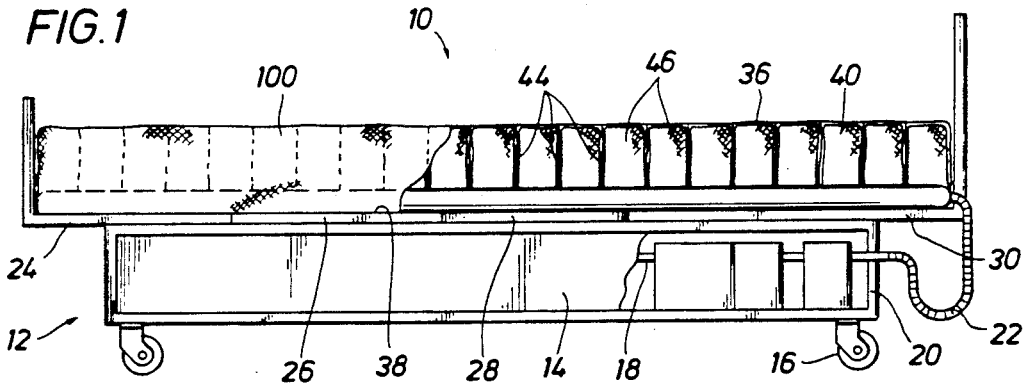
FIG. 1 is a side elevational view of a cellular therapeutic air bed system constructed in accordance with the present invention and being shown in the substantially flat position thereof.

Referring now to the drawings and first to FIG. 1, a multi-cell cellular therapeutic air bed constructed in accordance with the present invention is illustrated generally at 10 and is adapted to be supported on any suitable bed structure such as the hospital type adjustable platform bed illustrated generally at 12. Specific structure of the therapeutic air structure of the bed that is shown in the drawings is not intended to limit the spirit and scope of the present invention, it being obvious that other air bed structures may be employed. As shown, the bed 12 incorporates a base 14 supported by a plurality of casters 16 which enable the bed to be quite mobile so that it can be moved about. Within the base structure 14 is provided an air supply system including a motor M, a blower B, and a pressure control manifold P. The motor, for purposes of simplicity and to minimize the cost thereof, will typically be a single speed, electric motor which is connected by conductors 18 to a suitable source of electrical energy such as the 120 volt A/C power supply of a typical building such as a hospital, nursing home, residence, etc. The motor M will be directly connected to a blower B such that the blower operates at a single speed and delivers a discharge of compressed air via a discharge outlet 20. The outlet 20 is in communication with a valve controlled pressure control chamber P which in turn delivers the supply of air to a flexible air supply conduit 22.

Figure 2:
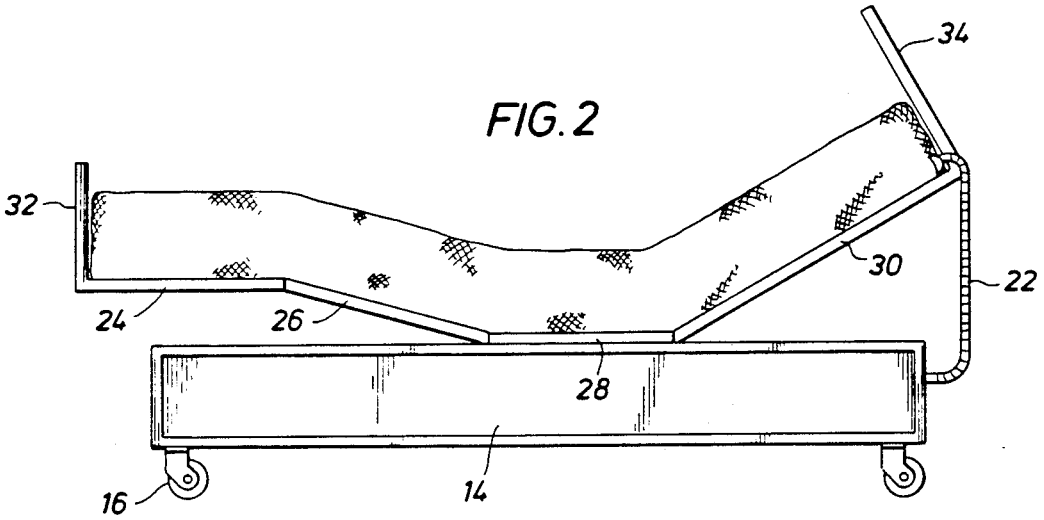
FIG. 2 is also a side elevational view of the cellular therapeutic air bed apparatus of FIG. 1, illustrating a raised position of the head and foot portions of the air bed system by adjustment of patient support platform sections.

The therapeutic air bed structure also includes a plurality of platform sections 24, 26, 28 and 30. Platform section 28 is fixed relative to the base structure 14 of the bed while platform sections 24, 26 and 30 are movable relative to the base 14 and also relative to the stationary platform section 28. As shown in FIG. 2, platform sections 24, 26 and 30 are shown to be elevated to thereby change the contour of the bed from a substantially flat configuration as shown in FIG. 1 to a configuration shown in FIG. 2 where the head and foot portions of the bed structure are elevated to thereby allow the patient to be in more of a sitting position if desired for patient comfort or therapy. The bed structure 12 will also include a footboard member 32 and a headboard member 34, to thus complete its basic structure.

Within the base 14 of the air bed 12 is located various electrical and mechanical components which are controllable to achieve movement of the support platforms as desired for patient comfort or therapy. The base structure of the bed will also typically include an alternative power supply such as batteries which are charged by the alternating current to which the electrical power supply system of the bed is connected. These batteries, together with the AC/DC aspects of the motor M will, therefor, insure that a supply of pressurized air remains continuous even in the event the therapeutic air or other building should suffer a temporary power failure. Many of the features of the hospital bed and its power supply are evident from the prior U.S. Pat. No. 4,638,519 issued to Jack H. Hess on Jan. 27, 1987. The basic structure of the movable platform bed 12 is well known in the health care industry and forms no specific part of the present invention. Other patient support bed structures may also be employed to support and position the cellular patient support system of this invention.

Figure 3:
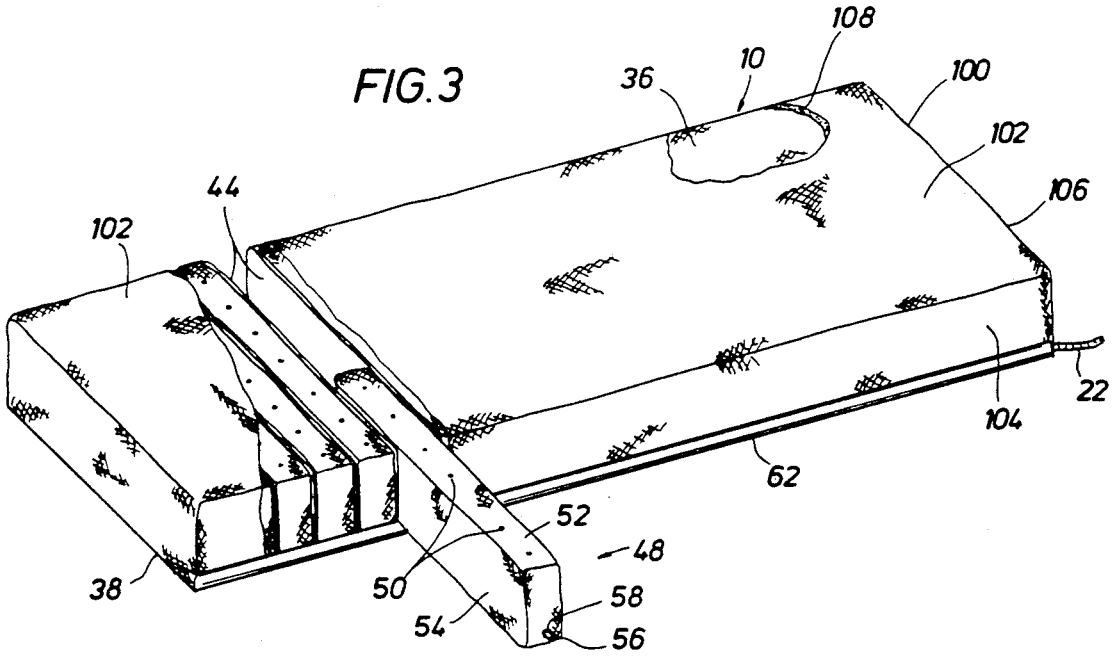
FIG. 3 is an isometric view of the cellular air mattress portion of the air bed system of FIGS. 1 and 2 with parts thereof broken away and shown in section and illustrating one of the removable air cells being partially withdrawn from its receptacle.

As shown in FIG. 1 and in FIG. 3, the cellular air bed construction of this invention comprises an air cell supporting and positioning container that incorporates upper and lower flexible panels 36 and 38 forming upper and lower surface of the cellular air bed structure and which are disposed in substantially parallel relation. The panels 36 and 38 form side and end panels 40 and 42 which overly respective side and end portions of the bed structure and define openings through which the air cells may be removed. If desired, an opening extending along the entire length of one of the side panels may be closed by a slide fastener or by another suitable means. A plurality of flexible transverse partitions 44 are sewn or otherwise fixed to the respective upper and lower sheets 36 and 38 and thus separate the space between the panels into a plurality of air cell compartments 46. The upper and lower panels or sheets 36 and 38 and the side and end panels may be formed from any of a number of acceptable fabrics. If desired, the transverse partitions 44 may be composed of the same fabric material from which the upper and lower sheets 36 and 38 are composed or, in the alternative, partition material of different composition may be effectively employed. The air cell container structure thus described is typically an all fabric construction which is capable of being sufficiently laundered or otherwise cleaned to maintain the sanitary characteristics of the air bed and to permit the fabric portions of the air bed to be regularly changed.

As shown particularly in FIG. 3, the cellular air cell support and positioning container 10 is provided a plurality of individual air cells which are removably received within the respective compartments 46. These air cells one of which is shown generally at 48 in FIG. 3 are composed of a fabric material which is appropriately coated or laminated to render it substantially impervious to air, water and solid matter. The air cells are typically formed from sheet material which is sewn or otherwise assembled at seams and joints to form a generally tubular, pillow-like structure which is of a form that substantially completely fills the respective compartments 46. To permit air to continuously bleed from the respective air cells to thereby form continuous air loss air cells, as shown in FIG. 3, the air cells may be provided with a plurality of small pin holes or vent openings 50 arranged along the upper surface 52 of the respective air cells thus forming the only air outlets for the air cells. The side surfaces 54 of the air cells will be substantially impervious to air unless otherwise designed for air flow. If desired, the air cells 48 may be composed of a fabric that is substantially impervious to air and the various components thereof may be assembled at seams such as by sewing. As the sewing needle penetrates the fabric, it will form a multitude of small openings or needle holes through which thread is extended. These small openings will also serve as air vents to thereby allow continuous flow of air from the air cells to the bed structure.

Another alternative form of the air cells will be provided by means of a fabric material which is pervious to air and thereby allows restricted flow of air from the air cells along substantially the entire surface area of the air cells or along desired surfaces thereof. In this case it will be unnecessary to provide specific air vent openings as shown in 50 in FIG. 3.

Figure 4:
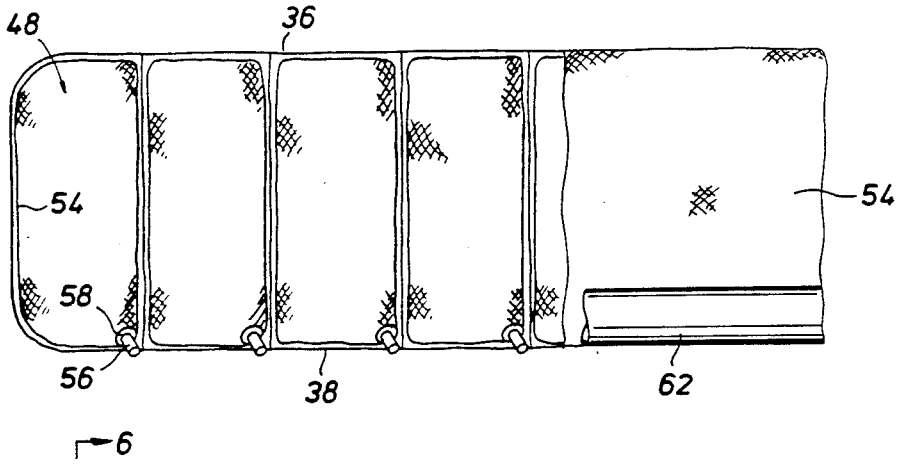
FIG. 4 is a partial side elevational view of the cellular air bed structure of FIG. 3 with parts thereof broken away and shown in section and illustrating the air supply receptacles of the individual removable air cells.
Figure 5:
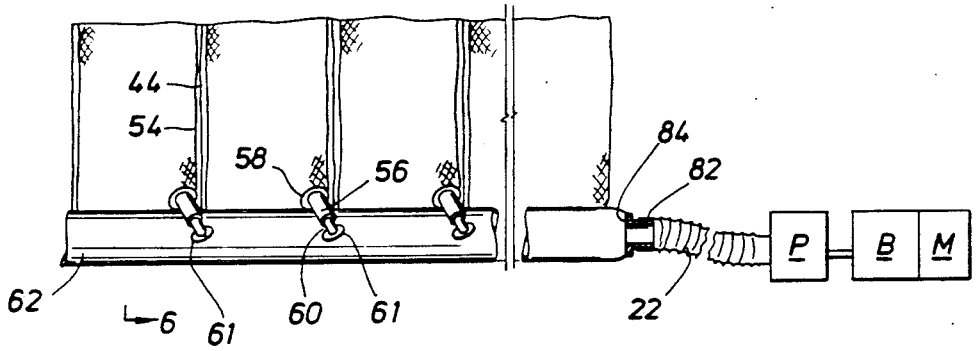
FIG. 5 is a partial side elevational view of the cellular air bed structure of FIGS. 3 and 4, illustrating the air supply connections of the air supply manifold to the individual air cells.
Figure 6:
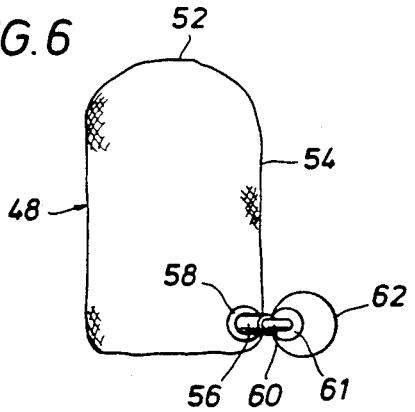
FIG. 6 is a sectional view along line 6—6 of FIG. 5 and further showing the details of the air supply connections between the tubular manifold and the individual air cells.
Figure 8:
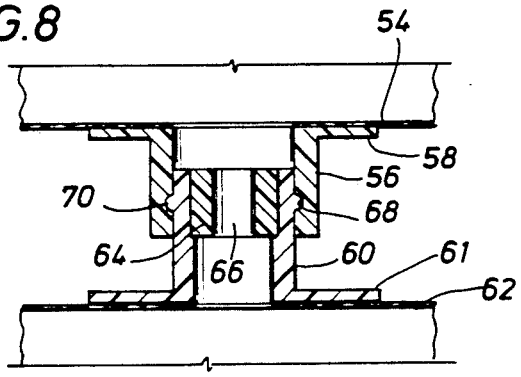
FIG. 8 is a sectional view illustrating the detailed structure of the air supply connections of FIG. 6.

Each of the air cells 48 is provided with an air inlet receptacle 56 which is bonded or otherwise assembled to respective end portions of the air cell. The air inlet receptacle includes a circular flange portion 58 having a connector receptacle extending therefrom and providing a receptacle opening. This connector receptacle is adapted for connection with one of a plurality of air inlet connectors 60 which are disposed in spaced relation along the length of an elongated supply manifold 62 and which include connector tubes that are received within the receptacle openings of the connector receptacles. The air supply manifold 62 is preferably composed of air impervious flexible sheet material such that it is capable of continuously flexing along its entire length as the air bed is changed from its substantially flat position as shown in FIG. 1, to an elevated position such as shown at FIG. 2. Each of the air inlet connectors 60 has disposed therein a pressure control orifice 64 as shown in FIG. 8, having a metering passage 66 formed therein which controls the volume of air allowed to flow from the manifold 62 into the respective air inlet connector 56. Thus, the air cell which is supplied by the air inlet connector 56 is capable of receiving a continuous flow of air which is governed by the dimension of the passage 66 in the orifice member 64. In order to facilitate connection between the respective air inlet receptacles 56 and the air supply connectors 60, an internal groove 68 is defined within each air supply receptacle, which groove is adapted to receive an external ridge 70 defined externally of the respective air inlet connectors 60. The annular ridge 70 will be received within the annular groove 68 by means of a snap-fit, thereby allowing the connectors 60 and receptacles 56 to be forcibly assembled or separated by application of manual force. Since the inflation pressure of the air cells is quite low, an air supply connector assembly may be employed having a connector and a receptacle that are maintained in assembly by a simple friction fit, especially where the connector and receptacle are formed of rather soft rubber-like polymer material. It is to be born in mind that the structure set forth in FIG. 8 is merely representative of one suitable means for quickly and efficiently establishing an air supplying connection between the elongated flexible manifold 62 and the respective air cells supplied thereby and for accomplishing metering of compressed air from the manifold to the respective air cells. Other air supply and metering connectors may be employed without departing from the spirit and scope of this invention. The type of air supply connector shown in FIG. 8 is illustrated in the end view of FIG. 6 and is also shown in FIGS. 4 and 5.

Figure 7:
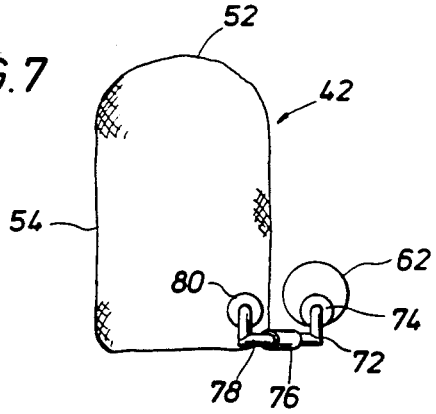
FIG. 7 is a partial sectional view similar to that of FIG. 6 and illustrating an alternative embodiment of the invention incorporating air supply connections of a form differing from that of FIG. 6.

As shown in FIG. 7, an alternative embodiment is illustrated wherein the air supply connector is of a differing form. The air cell structure 48 is of essentially the same form as shown in 48 in FIG. 6 and in other figures of the drawings. An air supply connector of L shaped configuration is shown at 72 which is provided with a circular connection flange 74 enabling it to be secured in assembly with the wall structure of the tubular manifold 62. The connector 72 includes an enlarged end portion 76 which contains therein a metering orifice element similar to that shown at 64 in FIG. 8. The connector 72 is also provided with an internal groove or rib structure similar to that shown at 68-70 in FIG. 8 and which is receivable by an appropriate external rib or groove provided on an air inlet connector such as shown at 78. The air inlet connector will also be of generally L shaped configuration and will be provided with a circular flange 80 enabling it to be secured to the wall structure of the air cell 48.

In order to supply the manifold 62 with air provided by the air blower B at a pressure controlled by the pressure control chamber P, the end portion of the manifold 62 is provided with a coupler 82 having a circular flange 84 which is secured to the fabric or other material of the manifold. About the coupler 82 is received one end of the flexible tubular air supply conduit 22. A retainer band of any suitable character may be employed to secure the conduit 22 to the coupler 82.

Figure 9:
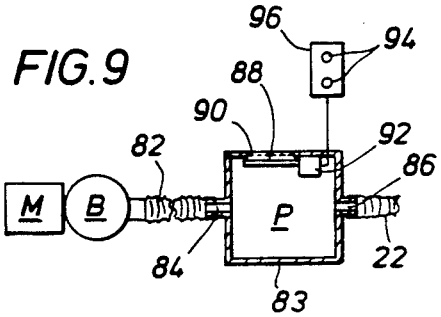
FIG. 9 is a schematic illustration of the air supply and pressure control system for controlling the firmness of the therapeutic air bed to the comfort of the patient.

As shown in FIG. 9 in schematic form, the air supply blower B is powered by an electrically energized motor M and is connected via a suitable conduit 82 to a housing 83 forming the pressure control chamber P. The pressure control housing has a single inlet connector 84 to receive the discharge conduit 82 extending from the air supply blower B and a single outlet connector 86 to which the air supply conduit 22 is connected. The pressure of air being supplied from the pressure control manifold P is controlled by means of a valve 88 which is positioned to cover one or all of a plurality of vent openings 90 that are formed by the wall structure of the housing 83. Opening and closing movement of the valve 88 is controlled by an electric motor 92 which is in turn controlled by push-button type control switches 94 of a remote control device 96. The remote control device is capable of being actuated by the patient or by other persons to control pressure of air within the pressure control chamber P and thus to control the firmness of the air bed. One of the control buttons 94 will be actuated to directionally energize the valve control motor 92, thereby moving the valve 88 to a position to uncover one or more of the vent openings 90. When this occurs, the pressure within the pressure control chamber P will decrease and therefor the pressure of air passing through the coupling 88 and the air supply conduit 22 to the tubular manifold 62 will be decreased. With the valve 88 closed, the pressure within the pressure control chamber P will be at its highest level and therefore air pressure entering the air cells through the conduit 22 and the tubular manifold 62 will be at its respective highest level. Thus by manipulating the pressure control device 96 the firmness of the air bed may be effectively controlled by the patient or by those in charge of the patient.

The cellular patient support unit including the cellular container and its air cells present a mattress-like air bed structure of generally rectangular form when the air cells are properly inflated. This air bed unit is then covered with a patient support cover as partially shown at 100 in FIG. 3, which fits about the patient support unit much like a fitted sheet is received about a mattress. The cover 100 includes an upper cover panel 102 and side and end panels 104 and 106. To the upper cover panel is fixed a layer of absorbant material 108 which is capable of wicking away moisture such as perspiration from the patient by capillary action. The moisture is then removed from the absorbant panel by the air flowing upwardly from the air cells.

The therapeutic cellular air bed of this invention is easily and quickly installed on a patient support platform. Rather than requiring multiple installations of individual air cells, the air bed is in the general form of a mattress with the various air cells thereof effectively contained and positioned in unitary manner by the cellular container. The pressures of the individual groups of air cells is effectively controlled by the air meeting orifice members of the spaced connectors 60 of the tubular manifold 62 and by the pressure controlling feature of the pressure control chamber P. Consequently, the pressure characteristics of the entire air bed structure is capable of being changed in a few minutes time simply by changing out the manifold 62 for a like manifold having metering orifices of differing size. The orifice devices may also be changed out if desired to change the relative pressures of the air cells.

The cellular container, which may also serve as the sheet of the air mattresses effectively maintains the rectangular configuration of the air bed and provides for air bed stability. Further, the cellular container is easily cleaned after the air cells are removed simply by laundering as if it were a conventional bed sheet.

Through manipulation of the comfort touch control device the air bed may be rendered more soft or more firm as suits the needs and comfort of the patient. The pressure relationships of the various groups of air cells forming the air bed will remain substantially the same throughout the operative pressure range of the air supply system of the air bed.

From the foregoing it will be seen that this invention is one well adapted to attain all of the ends and objects hereinabove set forth, together with other advantages which are obvious and which are inherent to the structure described herein.

It will be understood that certain features and subcombinations are of utility and may be employed without reference to other features and subcombinations. This is contemplated by, and is within the scope of the claims.

As many possible embodiments may be made of this invention without departing from the spirit and scope thereof, it is to be understood that all matter hereinabove set forth or shown in the accompanying drawings is to be interpreted as illustrative and not a limiting sense.

The invention having been described, what is claimed is:

1. A cellular patient support for adjustable, hospital type therapeutic air beds for use by convalescing patients and which have a plurality of platform sections that are relatively movable to provide angular adjustment of said platform sections as desired for the comfort comprising:

(a) upper and lower generally rectangular panels of flexible sheet material having a plurality of transverse partitions interconnected therebetween and disposed in parallel relation with one another and thus defining a flexible air cell container defining opposed sides and forming a plurality of air cell receptacles disposed in side-by-side relation, said air cell container adapted to rest upon a patient support bed structure;

(b) a plurality of air cells being removably positioned in respective ones of said air cell receptacles;

(c) an elongate tubular, non-jointed air supply manifold being positioned along one side of said air cell container and extending along the length of said air cell container, said elongate air supply manifold being composed of air impervious flexible material along its entire length and thus said tubular air supply manifold being continuously flexible along the entire length thereof so as to flex as the angular relationships of said platform sections are adjusted;

(d) a plurality of air supply connections positioned in spaced relation along the length of said air supply manifold;

(e) a plurality of corresponding air supply receptacles being provided one on each of said air cells and adapted for assembly with respective ones of said air supply connectors, thus forming air supply connector and receptacle assemblies placing said elongate air supply manifold in air supply communication with each said air cells;

(f) a plurality of replacable pressure control orifices being disposed in respective air supply receptacle and connector assemblies for selectively controlling respectively the volume of air flow through each of said air supply connector and receptacle assemblies and thus controlling the respective air pressure of said air cells; and (g) an air supply being disposed in air supplying communication with said elongate air supply manifold air supply manifold and through said pressure control orifices to said air cells to maintain said air cells inflated to pressures determined by the pressure of said compressed air and the dimension of said replacable pressure control orifices.

2. The cellular patient support construction recited in claim 1, wherein:

said upper and lower sheets of flexible material are composed of fabric which is pervious to air and moisture and which is substantially impervious to solid material, said air cell container capable of being cleaned.

3. The cellular patient support recited in claim 2, wherein:

said transverse partitions are composed of fabric sheet material.

4. The cellular patient support of claim 1, wherein:

side and end panels interconnect respective side and ends of said upper and lower sheets and define at least one side opening through which said air cells are extended during insertion into and removal from said air cell receptacles.

5. The cellular patient support of claim 1, wherein:

said plurality of air cells comprise groups, each group having a desired number of air cells disposed in side-by-side relation, each group of air cells having a preselected pressure range to support a particular portion of a patient's body, each of said groups of air cells being determined by the respective pressure control orifices of the air cells of each of said groups.

6. The cellular patient support recited in claim 5, wherein:

each of said pressure control orifices for said air supply connectors and receptacles of one of said groups of said air cells being of like dimension so that the air cells of each group of air cells will have substantially identical preselected pressure ranges.

7. The cellular patient support recited in claim 6, wherein:

said pressure control orifices of each of said groups of air cells are of differing dimension so that each air cell group of said therapeutic air bed will have an individually preselected pressure range.

8. The cellular patient support recited in claim 1, wherein:

said air supply has a preset volume and a variable pressure range.

9. The cellular patient support recited in claim 1, wherein said air supply comprises:

(a) a blower having a single speed motor for delivery of compressed air at a predetermined volume and pressure;

(b) a housing forming a pressure control chamber being in air receiving connection with said blower, said housing having an air supply outlet in air supplying communication with said elongate air supply manifold, said housing further forming at least one vent opening means; and (c) a vent control valve for controlling the effective dimension of said vent opening means and thus controlling air pressure within said pressure control chamber being communicated to said elongate air supply manifold.

10. The cellular patient support recited in claim 9, wherein:

(a) said vent opening means is defined by a plurality of vent openings formed by said housing; and (b) a valve position control device is connected in operating relation with said vent control valve for positioning of said vent control valve relative to said vent opening for closing said vent opening and for selective opening of said vent opening for controlled venting of pressurized air therefrom for control of the pressure of air therefrom.

11. The cellular patient support recited in claim 10, wherein:

(a) said valve control device is an electric motor and valve actuator mechanism disposed in position controlling relation with said vent control valve; and (b) an electrical valve control selector is coupled in operating relation with said electric motor and is manually manipulated for energization of said motor for selectively positioning said vent control valve relative to said plurality of vent openings.

12. A cellular patient support for adjustable, hospital type therapeutic air beds for use by convalescing patients and which have a plurality of platform sections that are relatively movable to provide angular adjustment of said platform sections as desired for the comfort and therapy of the patient, said cellular patient support comprising:

(a) upper and lower generally rectangular panels of flexible sheet material having a plurality of transverse partitions interconnected therebetween and disposed in parallel relation with one another and thus defining a flexible air cell container defining opposed sides and forming a plurality of air cell receptacles disposed in side-by-side relation, said air cell container adapted to rest upon a patient support bed structure;

(b) a plurality of continuous air loss air cells being removably positioned in respective ones of said air cell receptacles, each of said air cells having an air supply receptacle forming a passage through which compressed air is injected into the respective air cell;

(c) an elongate tubular, non-jointed flexible air supply manifold being composed of air impervious flexible sheet material along its entire length and thus said tubular, non-jointed air supply manifold being flexible along the entire length thereof and being positioned along one of said sides of said air cell container, said elongate tubular, non-jointed air supply manifold having a plurality of air supply connectors at spaced locations along the length thereof establishing air communicating connection with respective ones of said air supply receptacles of said air cells to form a supply connector and receptacle assembly;

(d) a plurality of replacable pressure control orifices being disposed within said air supply connectors for controlling respectively the volume of air flow through each of said air supply connector and receptacle assemblies and thus controlling the respective air pressures of said air cells; and (e) an air supply being connected to said elongate air supply manifold and communicating compressed air through said pressure control orifices to said air cells to maintain said air cells inflated to pressures determined by the pressure of said compressed air and the dimension of said pressure control orifices.

13. The cellular patient support construction recited in claim 12, wherein:

said upper and lower panels of flexible sheet material are composed of fabric which is pervious to air and moisture and which is substantially impervious to solid material.

14. The cellular patient support of claim 12, wherein:

side and end panels interconnect respective side and ends of said upper and lower sheets and define at least one side opening through which said air cells are extended during insertion into and removal from said air cell receptacles.

15. The cellular patient support recited in claim 12, wherein said air supply connection means comprises:

(a) a plurality of air supply connectors positioned in spaced relation along the length of said flexible air supply manifold;

(b) a plurality of corresponding air supply receptacles being provided one on each of said air cells and adapted for connection with respective ones of said air supply connectors, thus placing said elongate flexible air supply manifold in air supplying communication with each of said air cells;

(c) said plurality of pressure control orifices being coupled respectively with each connected pair of air supply connectors and receptacles and being of a preselected dimension for establishing a desired pressure range for its associated air cell; and (d) said air supply means comprising:

(1) a blower having a single speed motor for delivery of compressed air at a predetermined volume and pressure;

(2) a housing forming a pressure control chamber being in air receiving connection with said blower, said housing having an air supply outlet in air supplying communication with said elongate air supply manifold, said housing further forming at least one vent opening; and (3) a vent control valve for controlling the effective dimension of said vent opening means and thus controlling air pressure within said pressure control chamber being communicated to said elongate air supply manifold.

16. A cellular patient support for adjustable, hospital type therapeutic air beds for use by convalescing patients and which have a plurality of platform sections that are relatively movable to provide angular adjustment of said platform sections as desired for the comfort and therapy of the patient, said cellular patient support comprising:

(a) upper and lower generally rectangular panels of flexible sheet material having a plurality of transverse partitions interconnected therebetween and disposed in parallel relation with one another and thus defining a flexible air cell container forming a plurality of air cell receptacles disposed in side-by-side relation, said air cell container adapted to rest upon a patient support bed structure;

(b) a plurality of continuous air loss air cells being removably positioned in respective ones of said air cell receptacles said air cells each having a single air inlet opening and defining a plurality of holes through which compressed air therein is continuously vented;

(c) an elongate continuously flexible air supply manifold composed of air-impervious flexible sheet material along its entire length and thus said tubular air supply manifold being flexible along the entire length thereof and extending along substantially the entire length of said air cell container so as to flex as the angular relationships of said platform sections are adjusted;

(d) a plurality of air supply connectors positioned in spaced relation along the length of said manifold;

(e) a plurality of corresponding air supply receptacles being provided at the respective air inlet opening of each of said air cells and adapted for connection with respective ones of said air supply connectors, thus placing said elongate air supply connectors, thus placing said elongate air supply manifold in releasable air supplying communication with each of said air cells;

(f) an air supply being disposed in air supplying communication with said elongate flexible air supply manifold and supplying sufficient compressed air through said elongate flexible air supply manifold to said air cells to maintain said air cells properly inflated;

(g) said plurality of air cells comprise groups, each group having a desired number of air cells disposed in side-by-side relation, each group of air cells having a preselected pressure range to support a particular portion of a patient's body; and (h) each connected pair of air supply connectors and receptacles having an orifice fitting replacably positioned therein and forming an orifice of a preselected dimension for establishing a desired pressure range for its associated air cell, each of said orifices for said air supply connectors and receptacles of a group of said air cells being of like dimension so that the air cells of each group of air cells will have preselected pressure ranges, the orifices of each group of air cells being of differing dimension so that each air cell group of said therapeutic air bed will have an individually preselected pressure range.

17. The cellular patient support for therapeutic air beds as recited in claim 16, wherein said air supply comprises:

(a) a blower having a single speed motor for delivery of compressed air at a predetermined volume and pressure;

(b) a housing forming a pressure control chamber being in air receiving connection with said blower, said housing having an air supply outlet in air supplying communication with said flexible elongate tubular air supply manifold, said housing further forming at least one vent opening means; and (c) a vent control valve for controlling the effective dimension of said vent opening means and thus controlling the air pressure within said pressure control chamber and thus the air pressure being communicated to said elongate tubular flexible air supply manifold.

* * * * *